US007328717B1

(12) United States Patent
Hertz

(10) Patent No.: US 7,328,717 B1
(45) Date of Patent: Feb. 12, 2008

(54) PLUMBING VALVE COVER FOR AVOIDING INTERFERENCE WITH FAUCET HOSE

(76) Inventor: Allen D. Hertz, 12784 Tulipwood Cir., Boca Raton, FL (US) 33428

( * ) Notice: Subject to any disclaimer, the term of this patent is extended or adjusted under 35 U.S.C. 154(b) by 235 days.

(21) Appl. No.: 11/285,549

(22) Filed: Nov. 22, 2005

(51) Int. Cl.
*F16K 27/08* (2006.01)

(52) U.S. Cl. ..... 137/382; 4/654

(58) Field of Classification Search ..... 137/377, 137/382; 4/654
See application file for complete search history.

(56) References Cited

U.S. PATENT DOCUMENTS 3,724,491 A * 4/1973 Knudsen et al. ..... 137/375
4,862,528 A * 9/1989 Clarke et al. ..... 4/661
5,363,517 A * 11/1994 Botsolas ..... 4/661
5,675,847 A * 10/1997 Pierre ..... 4/654
D390,643 S * 2/1998 Trueb et al. ..... D23/308
D431,288 S * 9/2000 Helmsderfer ..... D23/308
6,807,691 B1 * 10/2004 Hertz ..... 4/654
7,143,780 B1 * 12/2006 Pitts ..... 137/382

* cited by examiner

*Primary Examiner*—John Fox
(74) *Attorney, Agent, or Firm*—Allen D. Hertz

(57) ABSTRACT

A plumbing valve cover is disclosed for use in conjunction with under-sink plumbing to avoid interference with the operation of a flexible spray nozzle hose used in conjunction with a spray nozzle. The plumbing valve cover may be coupled to the under-sink plumbing or cabinet wall. The plumbing valve cover may partially cover the under-sink plumbing and include clearances for multiple plumbing lines which may exit a supply valve via either the top, bottom, or sides. The preferred embodiment would be a single piece, injection molded plastic apparatus comprising a horizontal member which covers the top of the valve and two vertical members. The vertical members would be angled or curved to redirect the flexible hose away from getting caught on the valve. The horizontal member can include a pitch to redirect the hose away from the cover or valve when the hose is being retracted into the cabinet.

20 Claims, 8 Drawing Sheets

PLUMBING VALVE COVER FOR AVOIDING INTERFERENCE WITH FAUCET HOSE

RELATED U.S. PATENT APPLICATIONS

The invention relates to U.S. Pat. No. 6,807,691 issued on Oct. 26, 2004, which is incorporated herein by reference.

FIELD OF THE INVENTION

This invention relates in general to the field of under-sink plumbing valve covers, and in particular to a plumbing valve cover which is placed about an under-sink supply valve or similar object wherein such object may interfere with the operation of a spray nozzle and associated flexible, movable hose, generally used in conjunction with a kitchen sink.

BACKGROUND OF THE INVENTION

Sinks or washbasins may include a spray nozzle or water dispenser which is attached to a flexible hose, where the flexible hose retracts into an opening and is stored freely under the sink. A weight or spring may be attached to the hose to assist in retracting the hose into the opening and improve storage control of the flexible hose under the sink. The hose generally is provided through an opening on the side/rear of the sink (Side Spray), or through an opening in the center of a faucet (Pullout faucet).

Water supply lines enter from the wall, pass through an opening in a cabinet and are coupled to a valve. A supply line exits the valve and connects to a faucet control such that the user can turn the water on and off. It is recognized that there may be hot and cold water lines, as well as multiple inlet lines exiting from each valve for other appliances such as refrigerators or dish washing machines.

The supply line is normally horizontal which may be the optimal orientation for installing the cabinets. The valve generally has an oval shaped handle. The handle is generally larger than the water supply line. The orientation of the plumbing and the handle on the valve creates a scenario that can interfere with the movement of the loose hose. It can be seen that a hose of sufficient length can loop below the horizontal water supply line or lines and become entrapped. This may preclude the spray nozzle from fully deploying and hindering operation or even render the nozzle useless.

Spray nozzle hoses normally comprise a weight to assist in drawing the hose back, below the sink, referred to as a retraction step herein. The hose can get caught on top of an object during the retraction step.

Hertz (U.S. Pat. No. 6,807,691)(Issued to the present Inventor) defines a design that is optimal to a valve that is parallel with a supply line. Plumbing installations can further comprise two valves positioned perpendicular to said supply line.

Thus, what is necessary is a low cost and efficient apparatus for avoiding the interference between the retractable hose and the plumbing and valves that provides for broad applications.

SUMMARY OF THE INVENTION

One aspect of the present invention is to provide a low cost apparatus for at least partially shielding under-sink plumbing.

A second aspect of the present invention is the design of the low cost apparatus such that the apparatus will preclude interference from the under-sink plumbing with the retractable hose.

A third aspect of the present invention is the design of the apparatus for easy installation and removal.

A fourth aspect of the present invention is the design of the apparatus such that the apparatus snaps onto a feature of the plumbing.

A fifth aspect of the present invention is a design that includes a two-piece system which can snap, be screwed together, and the like to fasten around a feature of the plumbing.

A sixth aspect of the present invention is a design such that the knob for the respective valve remains exposed to allow operation without removal of the present invention.

A seventh aspect of the present invention is the inclusion of reference markings, notch, removable feature, and the like to provide for clearances for various supply and inlet lines as well as fitting between the cabinet and the plumbing valves.

A seventh aspect of the present invention is the inclusion of a label or printed identifier used for advertisement or promotional means, such as including the contact information for a respective plumber.

An eighth aspect of the present invention is the ability to manufacture the apparatus using injection molding.

A ninth aspect of the present invention is the inclusion of a slot(s), the slots providing for cable ties as a means to couple the present invention to the under-sink plumbing.

A tenth aspect of the present invention is the inclusion of a means to secure the present invention to at least one of the cabinet or a wall.

An eleventh aspect of the present invention is to fabricate the present invention of a semi-rigid or rigid material.

A twelfth aspect of the present invention is an application or design such to reinforce or increase the rigidity of the present invention along a line of contact of the hose.

A thirteenth aspect of the present invention is a cover positioned above said valve.

A fourteenth aspect of the present invention is a cover positioned above said valve, wherein said cover is at least one of as broad as said valve and wider than said valve.

A fifteenth aspect of the present invention is a cover positioned above said valve, wherein said cover is at least one of as broad as said valve and wider than said valve, wherein said cover is tapered as follows: an edge proximate the wall is wider than an edge farthest from the wall.

A sixteenth aspect of the present invention is a cover positioned above said valve, wherein said cover comprising at least one member which protrudes below said valve for guiding said spray nozzle hose around said valve, thus avoiding any interference.

A seventeenth aspect of the present invention is a cover positioned above said valve, wherein said cover comprising at least one hose guide member which protrudes below said valve for guiding said spray nozzle hose around said valve, thus avoiding any interference, said hose guide member further comprising an aperture for routing any additional plumbing.

An eighteenth aspect of the present invention is a cover positioned above said valve, wherein said cover further comprising at least one pitch for avoiding interference with said hose during the retraction process.

Brief Description of the Drawings

| Nr. | Index |
|---|---|
| 10 | Sink |
| 12 | Cabinet |
| 14 | Faucet |
| 16 | Faucet handle |
| 18 | Spray nozzle |
| 20 | Flexible sprayer hose |
| 22 | Sink hose opening |
| 24 | Supply line plumbing |
| 26 | Supply line valve |
| 28 | Supply line valve handle |
| 30 | Inlet line plumbing |
| 32 | "P trap" |
| 34 | Flexible hose weight |
| 36 | Cabinet doors |
| 38 | Cabinet rear wall |
| 40 | Plumbing valve cover |
| 42 | Plumbing valve cover mount |
| 44 | Supply line connector |
| 46 | Valve to sink inlet line connector |
| 48 | Accessory supply line(s) |
| 50 | Flexible hose directing path |
| 52 | Plumbing aperture |
| 54 | Plumbing valve cover Supporting structure |
| 60 | User applied lifting force |
| 62 | Normal force |
| 64 | Tangential force |
| 70 | Inlet line clearance |
| 72 | Wall mounting hole |
| 74 | Coupling hardware |
| 76 | Supporting rib(s) |
| 78 | Generally horizontal member |
| 80 | Perpendicular reinforcing member |
| 82 | Hose deflecting member |
| 84 | Pitch angle |

DETAILED DESCRIPTION OF THE INVENTION

Figure 1:
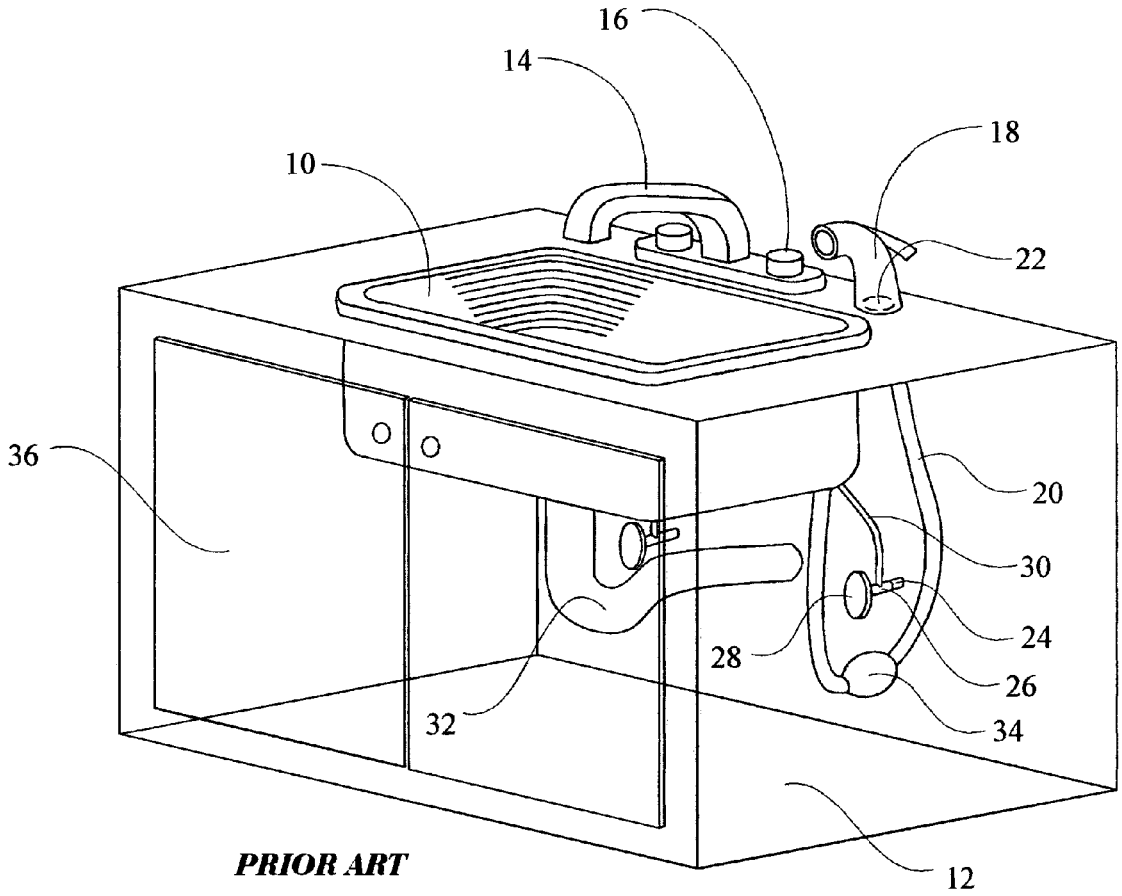
FIG. 1 is an isometric view of a kitchen sink, a supporting cabinet, and respective plumbing.

FIG. 1 illustrates an isometric view of a sink 10 mounted within a cabinet 12 to illustrate the need for the present invention. A faucet 14 and faucet handles 16 are generally mounted through holes located in either the sink 10 or the top of the cabinet 12. A spray nozzle 18 may be accessed through a flexible hose opening 22 located adjacent to the faucet 14 or through a flexible hose opening in the faucet 14 (not shown in that configuration). The spray nozzle 18 is coupled to an exit end of a flexible hose 20 with an inlet end of the flexible hose 20 coupled to the plumbing (not shown) to provide water (not shown) to the spray nozzle 18. There are many methods known to couple the hose to each fixture. The water is provided to the system through supply line plumbing 24, a supply line valve 26 and inlet line plumbing 30, normally one for cold water and a second for hot water. The supply line valve 26 may be designed in various configurations. The supply line valve 26 is illustrated in an angled configuration, where the supply valve handle 28 would be located in front of the plumbing. Alternatively, supply line valves 26 may be configured as a through valve where the supply valve handle 28 is located on the top of the valve. The supply line valve 26 may be configured to include one or more connections for outputs to provide for inlet lines 30 to the sink or other appliances. The water drains through a P-Trap 32 which has a first end of the P-Trap 32 is coupled to a drain (not shown) located at the bottom of the bowl of the sink 10 and a second end of the P-Trap 32 is coupled to a sewage line (not shown) generally located at the back of the cabinet.

It can be recognized from the illustration that the under-sink plumbing comprising supply line plumbing 24, supply line valve(s) 26, and supply line valve handle(s) 28 would interfere with the flexible hose 20 when the flexible hose 20 is pulled through the flexible hose opening 22 by the user.

The figure is provided to illustrate a general arrangement of plumbing located under a sink, where the plumbing includes a spray nozzle 18 coupled to the flexible hose 20.

Figure 2:
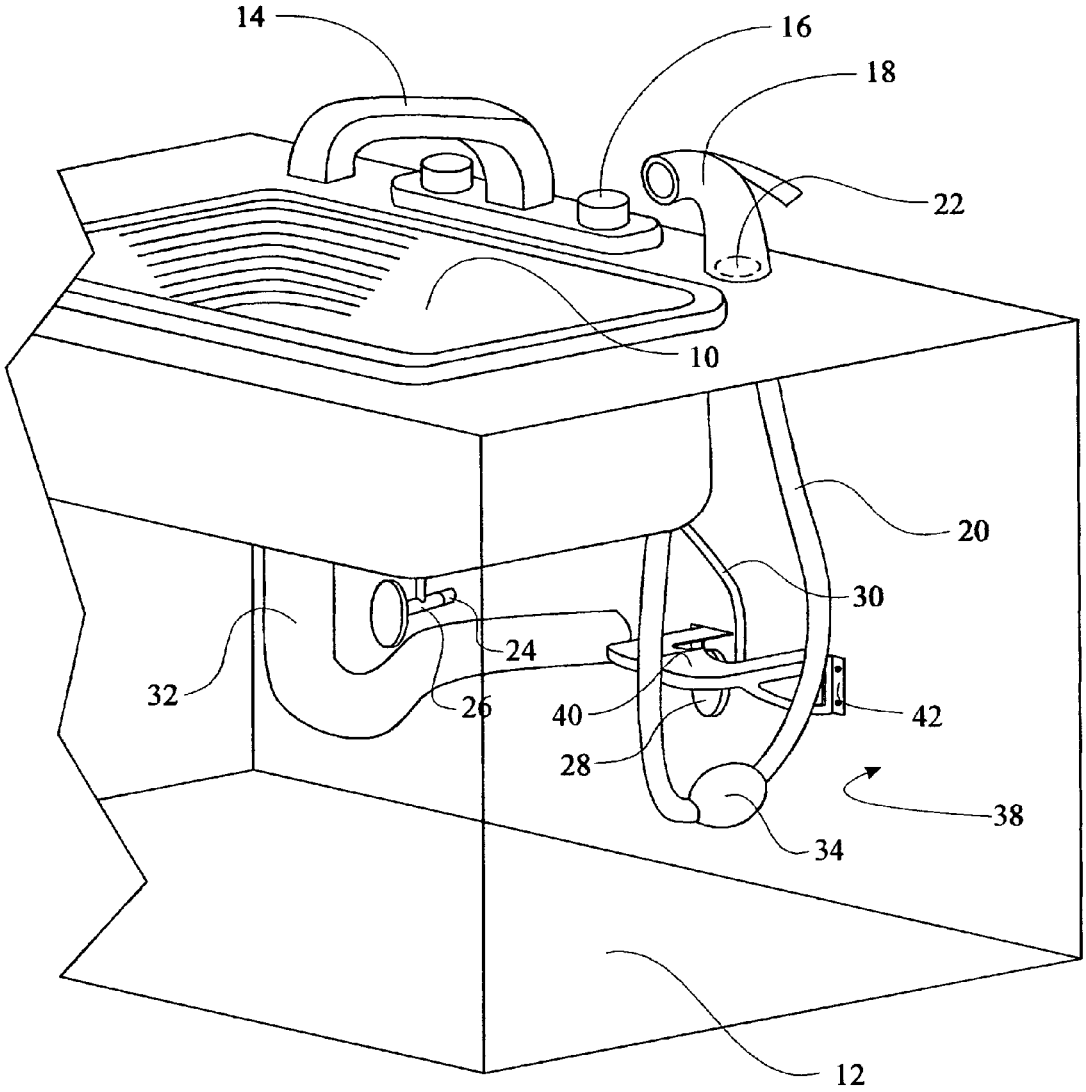
FIG. 2 is an isometric view of a plumbing valve shield installed in accordance with the preferred embodiment of the present invention.

FIG. 2 is an enlarged section of the isometric view of FIG. 1 including the present invention installed according to a preferred embodiment. In accordance with the preferred embodiment of the present invention, a plumbing valve cover 40 is mechanically coupled to a cabinet rear wall 38 via at least one plumbing valve cover mount 42. It can be recognized that there are many other methods of securing said plumbing valve cover 40 into position such as a pipe clamp around the supply valve 26, secured by a snap feature, screws, and the like. It should be recognized that the method of installation should not limit the present invention.

The function of the plumbing valve cover is exhibited by the illustration whereby the design of the plumbing valve cover 40 allows at least one of the flexible hose 20 and flexible hose weight 34 to ride against the plumbing valve cover 40 thus avoiding interference between the lower service loop of the flexible hose 20 and the supply valve 26, supply valve handle 28, and other such plumbing. This will be described in more detail below. In the present state, as the flexible hose 20 is pulled through the flexible hose opening 22, the plumbing would interfere with the lower service loop created by the geometry of the flexible hose 20. The inclusion of the present invention provides a hose deflector (lower member) whereby when the service loop created in the flexible hose 20 rides against the hose deflector of the plumbing valve cover 40; the flexible hose 20 would not be caught in the plumbing. The bottom of the plumbing valve cover 40 is designed such that when the flexible hose 20 is pulled upwards through the flexible hose opening 22, the lower service loop rides along the hose deflector of the plumbing valve cover 40 and moves in front of the supply valve 26, supply valve handle 28, and associated plumbing thus avoiding any interference. Further, by adding a pitch to the upper surface of the plumbing valve cover 40, the flexible hose 20 rides to the side of the plumbing valve cover 40 when the flexible hose 20 is retracted into the flexible hose opening 22.

Figure 3:
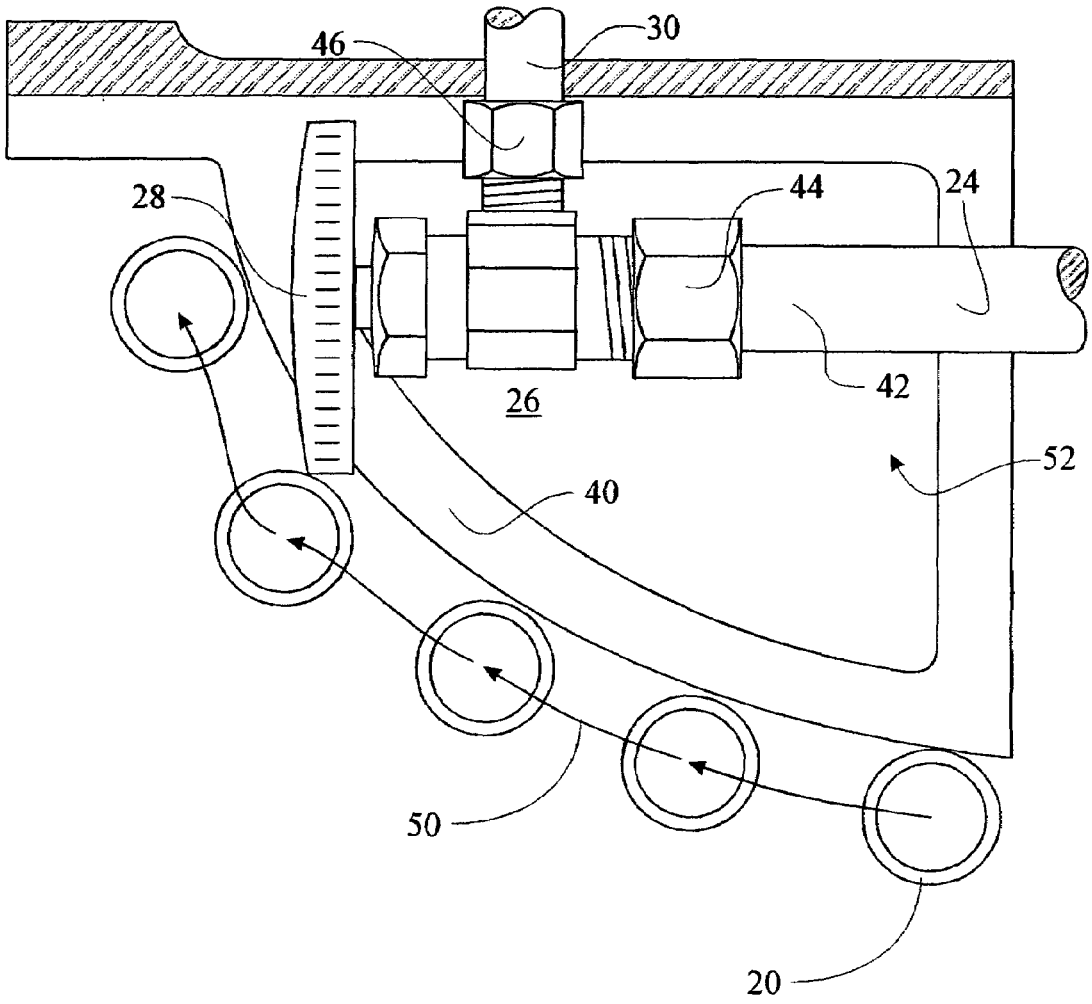
FIG. 3 is a cross sectional side view of the installed plumbing valve shield.

FIG. 3 is a cross-sectional view of the plumbing valve cover 40 further illustrating the resulting motion of the flexible hose 20 respective to the plumbing valve cover 40 as the flexible hose 20 is lifted through the flexible hose opening 22. The supply valve assembly 26 includes a supply line connector 44 for coupling the supply valve 26 to the supply line plumbing 24, a valve to sink inlet line connector 46 for coupling the supply valve 26 to the inlet line plumbing 30 and the supply line valve handle 28. The shape of the supply valve 26 provides ample locations for mechanically coupling the plumbing valve cover 40, using any of known mechanical coupling methods such as a plumbing valve cover mount 42 which, in one embodiment, comprising a flange style mount as shown. The plumbing valve cover 40 would be shaped in a manner to provide for the flexible hose 20 to move along a flexible hose directing path 50 when being raised through the flexible hose opening 22 by the user. In accordance with the illustrated embodiment, said plumbing valve cover 40 comprising a generally horizontal member 78 which is designed to span across said supply valve 26 and at least one generally vertical member 82 protruding downward from said generally horizontal member. Although said generally horizontal member 78 is described as horizontal, it is recognized that by defining said generally horizontal member 78 as "generally", any shape to span across the width of the valve would be considered within the spirit and intent of the present invention. Said generally vertical member is designed to direct the flexible hose 20 from catching on said supply valve 26. The plumbing valve cover 40 may further include a plumbing aperture section 52 whereby additional plumbing which may exit the sides (shown later herein) of the supply valve 26. The clearance may be included in the design as shown or of removable sections. Such removable sections may include scribe lines, precut sections, and the like to simplify the removal process.

Figure 4:
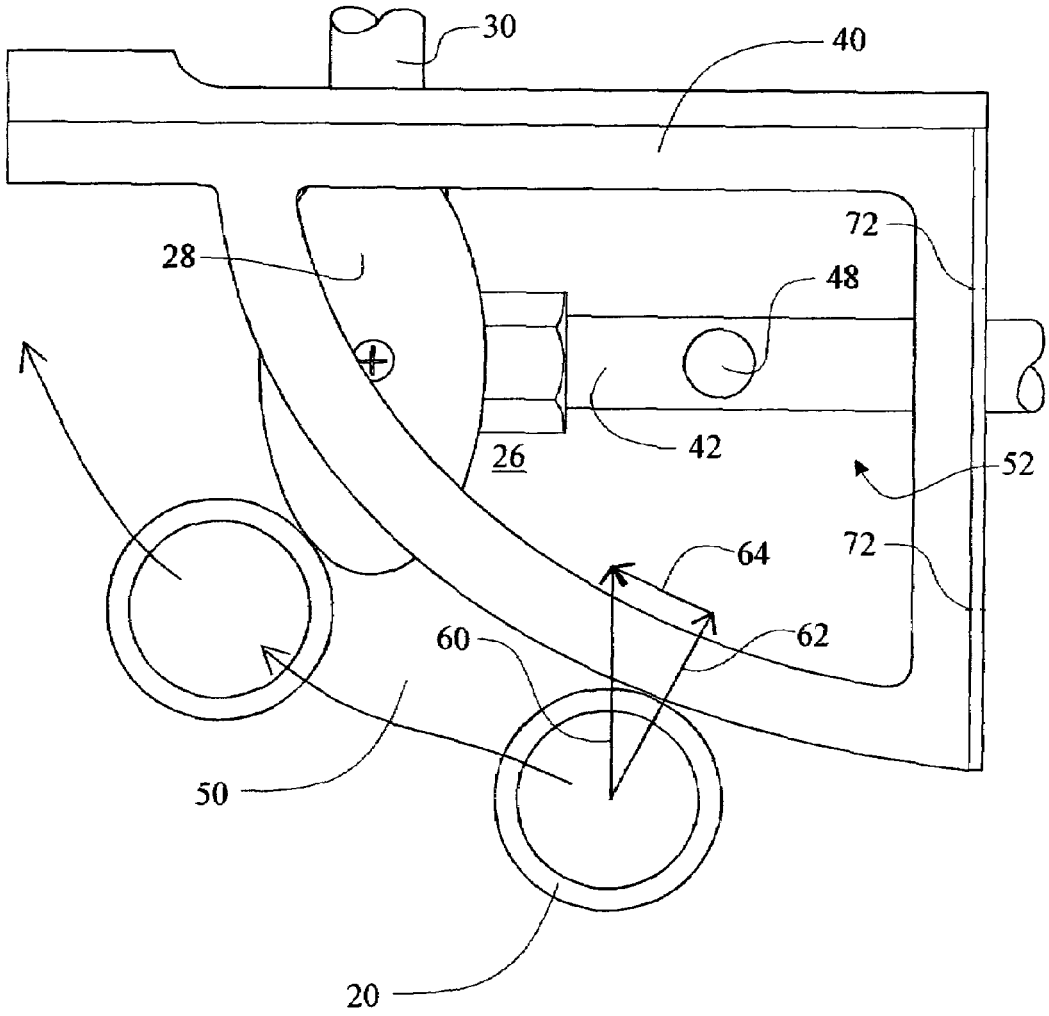
FIG. 4 is an enlarged sectional side view of FIG. 3 including a free body diagram further illustrating the forces provided which move a flexible hose around the plumbing valve.

FIG. 4 is a cross sectional view of the present invention as in FIG. 3 including a free body diagram illustrating the forces which move the flexible hose 20 to avoid interfering with the plumbing. When the user lifts the flexible hose 20 through the flexible hose opening 22, the hose introduces a user-applied force 60. The user-applied force 60 is composed of a normal force 62 and a tangential force 64. The tangential force 64 moves the flexible hose 20 in a manner to avoid interference with the plumbing. The illustration further introduces an accessory supply line(s) 48 shown exiting through said plumbing aperture section 52. The illustration presents a proposed flexible hose directing path 50 providing a detail where the flexible hose 20 would move around the supply line valve handle 28, should the design allow the supply line valve handle 28 to protrude slightly. Said plumbing valve cover 40 is installed by fastening said plumbing valve cover 40 to said cabinet rear wall 38.

Figure 5:
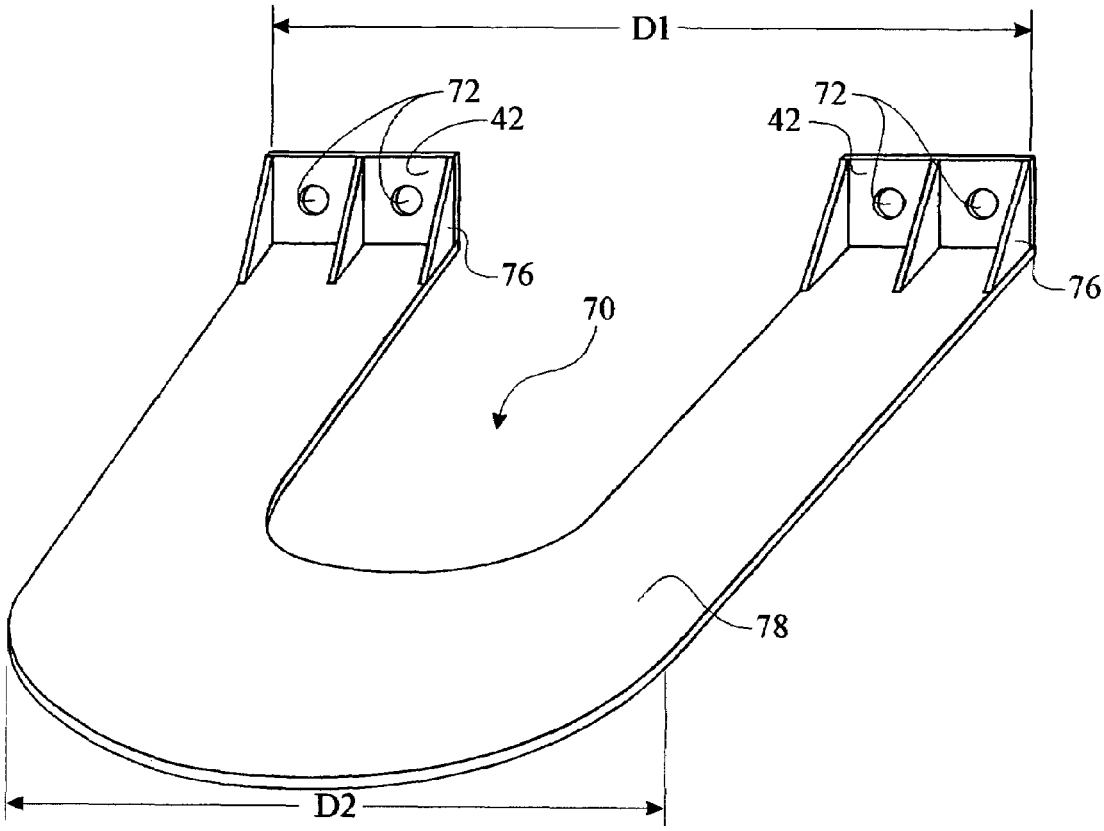
FIG. 5 is an isometric view of an above-valve style valve shield in accordance with a first embodiment of the present invention.

FIG. 5 is an isometric view of an alternate embodiment of the present invention. The described alternate embodiment includes the plumbing valve cover 40 which avoids interference with the flexible hose 20 (not shown in this figure), said plumbing valve cover 40 comprising a generally horizontal member 78, a inlet line clearance 70, and at least one plumbing valve cover mount 42. The illustrated embodiment of said plumbing valve cover 40 presents said generally horizontal member 78 designed with a taper to guide the flexible hose 20 around the supply valve 26. The taper comprising a wall width D1 proximate the wall and a smaller, distant width D2 across the dimension of the generally horizontal member 78 opposing the wall. Although a taper is not required, it would be desirable for assisting the interference avoidance process. Said inlet line clearance 70 is also shown, wherein said inlet line clearance 70 provides a clearance for said inlet line plumbing 30. The preferred embodiment of said inlet line clearance 70 comprising a "U" shaped clearance providing a means for an easy installation. It can be recognized that any design shape should maintain the spirit and intent of the present invention, wherein said inlet line clearance 70 allows the user to install said plumbing valve cover 40 without disconnecting and reconnecting the primary plumbing connections. Said at least one plumbing valve cover mount 42 is preferably a flange type design with at least one wall mounting hole 72. Said plumbing valve cover mount 42 can, optionally, be reinforced by incorporating at least one reinforcing rib(s) 76. Additionally, said generally horizontal member 78 can, optionally, be reinforced by providing a vertical trim about the perimeter of said generally horizontal member 78 (as shown later). The plumbing valve cover 40 may be manufactured from stamped metal, molded plastic, or any other means to provide the desired shape.

Figure 6:
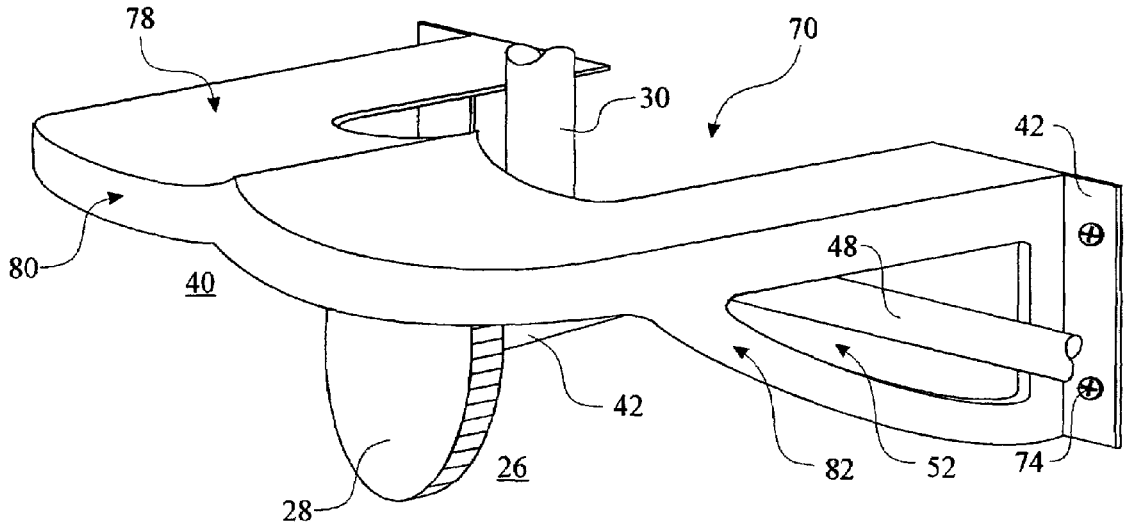
FIG. 6 is an isometric view of an above-valve plumbing valve shield with downward hose directing guards in accordance with a second embodiment of the present.

FIG. 6 is an isometric view representative of a second embodiment of the present invention. The described an alternate embodiment which presents the plumbing valve cover 40 which avoids interference with the flexible hose 20 (not shown in this figure) and a means of mounting the plumbing valve cover 40. Said plumbing valve cover 40 comprising said generally horizontal member 78, said inlet line clearance 70, at least one plumbing valve cover mount 42, and a hose deflecting member 82. Said hose deflecting member 82 is preferably designed to be generally downward, designed to direct the flexible hose 20 around said supply valve 26. It can be recognized that any design to accomplish this task is considered within the spirit and scope of the present invention. Said plumbing aperture section 52 can optionally be incorporated to provide a means for accommodating accessory supply line(s) 48 as shown. One would temporarily disconnect said accessory supply line(s) 48, position said accessory supply line(s) 48 through said plumbing aperture section 52 and re-secure said accessory supply line(s) 48. Said plumbing valve cover 40 would be fastened to the adjacent wall via coupling hardware 74 placed through said mounting hole(s) 72. Said plumbing aperture section 52 can further provide a means for accessing said supply valve handle 28, easing the accessibility for the user to turn the supply valve handle 28. Said generally horizontal member 78 can be reinforced by incorporating a perpendicular reinforcing member 80 which is generally perpendicular to and running the length of said generally horizontal member 78. Said generally horizontal member 78 further comprising a pitched top surface, wherein said pitch is incorporated to aid in deflecting a retracting flexible hose 20. Said pitch will be illustrated in more detail later.

Figure 7:
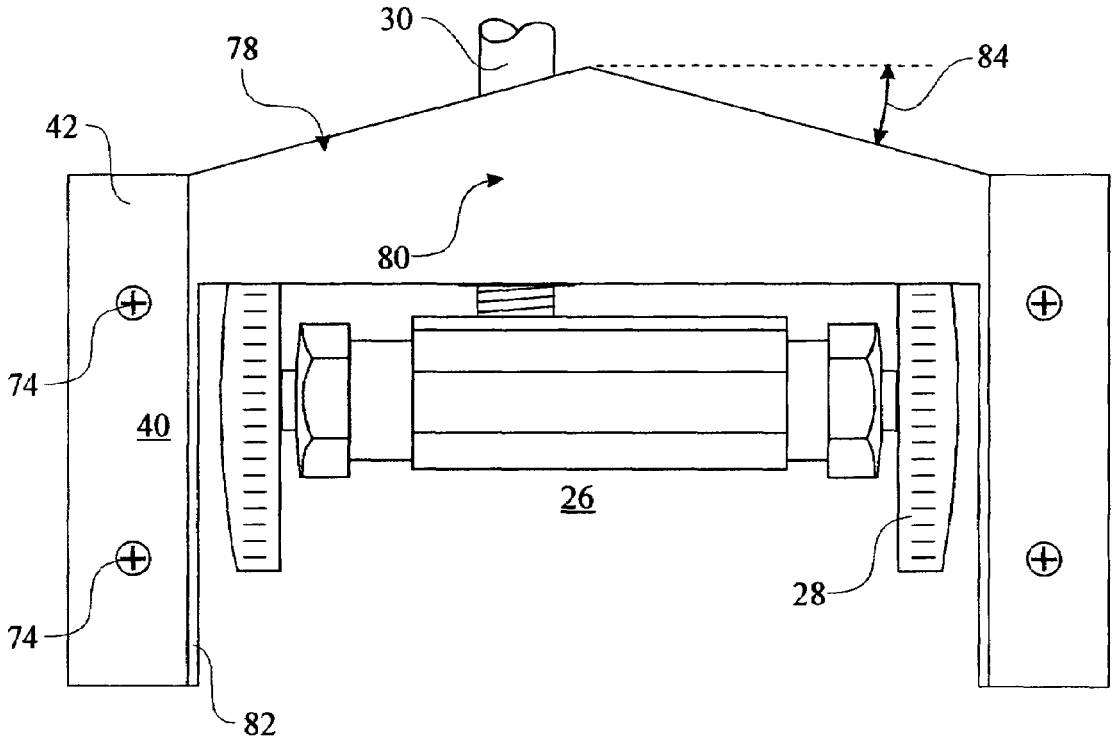
FIG. 7 is a front view of an above-valve plumbing valve shield with downward hose directing guards in accordance with a second embodiment of the present.

FIG. 7 is a front, elevation view of said plumbing valve cover 40. The illustration presents an improved view of the pitch, shown as the pitch angle 84 of the top surface of said generally horizontal member 78. Said pitch angle 84 is provided to guide the flexible hose 20 away from the plumbing valve cover 40/supply valve 26.

Figure 8:
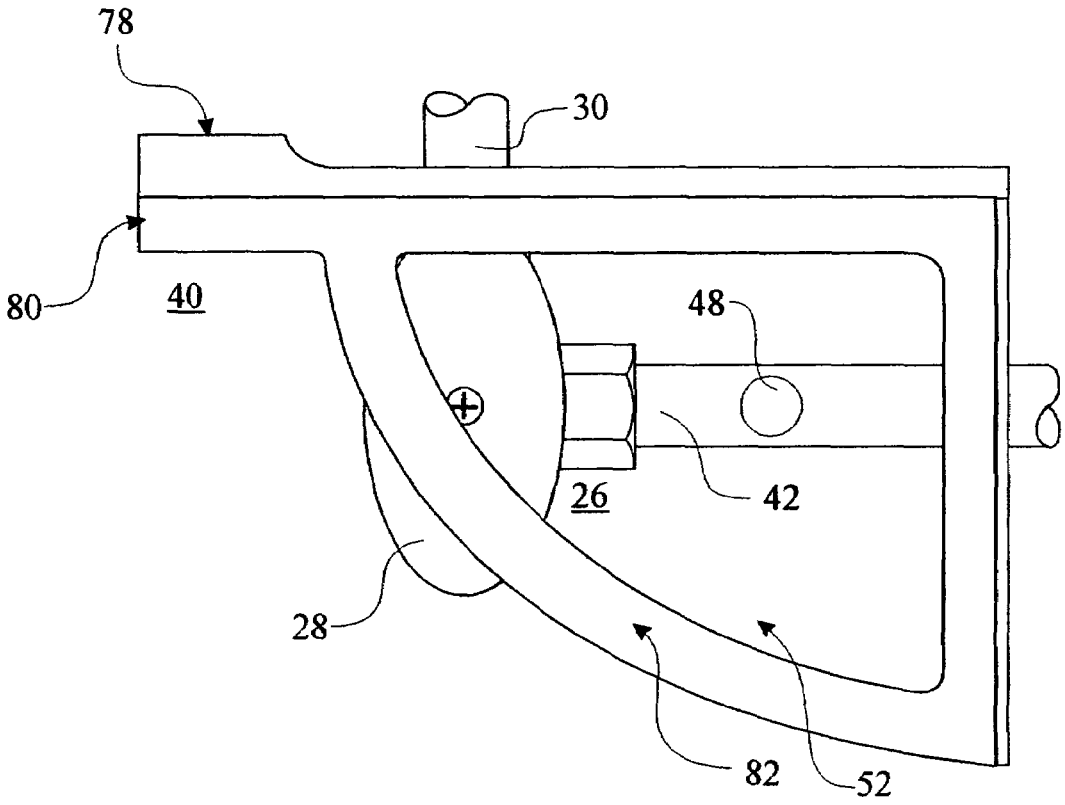
FIG. 8 is an elevation view of an above-valve plumbing valve shield with downward hose directing guards in accordance with a second embodiment of the present.

FIG. 8 is a side, elevation view of said plumbing valve cover 40 illustrating the same elements taught in previous illustrations. This view presents the advantage of incorporating said plumbing aperture section 52 as a means for accessing said supply valve handle 28 allowing the user to open and close said supply valve 26.

It can be recognized that the variations of design or features for achieving the aspects of the present invention should not limit the spirit, scope or intentions of the present invention. It can be recognized that advertisements may be applied via labels, printed onto the surface, embossed on the surface, molded into the material, and the like.

The plumbing valve cover can be manufactured using injection molding processes, metal forming processes, machining processes (although they are normally cost prohibitive), and the like. The materials can be of rubber, plastic, resins, metal, or any other (preferably cost effective) material.

What is claimed is:

1. A plumbing valve cover apparatus for avoiding interference between under-sink plumbing and a flexible spray hose for a spray nozzle, said plumbing valve cover apparatus comprising:

a generally horizontal member designed to at least proximate a width of a sink supply line valve such to be positioned above said sink supply line valve, and designed to reposition said flexible spray hose towards the front of said sink supply line valve as said flexible spray hose is pulled upwards; and a member for securing said plumbing valve cover to at least one of:

a) the sink supply line valve, b) a supply line piping, c) an the inlet line plumbing, d) a sink cabinet, and e) a wall.

2. The plumbing valve cover of claim 1, wherein the plumbing valve cover further comprising at least one downward protruding member, whereby said downward protruding member is designed to reposition said flexible spray hose towards the front of said sink supply line valve as said flexible spray hose is pulled upwards.

3. The plumbing valve cover of claim 2, wherein said downward protruding member further comprising an aperture for at least one of passing plumbing through and assisting in accessing a valve handle for said sink supply line valve.

4. The plumbing valve cover of claim 3, said generally horizontal member further comprising a pitch on an upper surface.

5. The plumbing valve cover of claim 2, said generally horizontal member further comprising a pitch on an upper surface.

6. The plumbing valve cover of claim 1, said generally horizontal member further comprising a pitch on an upper surface.

7. The plumbing valve cover of claim 1, wherein said generally horizontal member is of a taper, said taper defined with a wall width and a cantilevered width, wherein said wall width is wider than said cantilevered width.

8. A plumbing valve cover apparatus for avoiding interference between under-sink plumbing and a flexible spray hose for a spray nozzle, said plumbing valve cover apparatus comprising:

a generally horizontal member designed in a "U" shape and to at least proximate a width of a sink supply line valve such to be positioned above said sink supply line valve, and designed to reposition said flexible spray hose towards the front of said sink supply line valve as said flexible spray hose is pulled upwards; and a member for securing said plumbing valve cover to at least one of:

a) the sink supply line valve, b) a supply line piping, c) an the inlet line plumbing, d) a sink cabinet, and e) a wall.

9. The plumbing valve cover of claim 8, wherein the plumbing valve cover further comprising at least one downward protruding member, whereby said downward protruding member is designed to reposition said flexible spray hose towards the front of said sink supply line valve as said flexible spray hose is pulled upwards.

10. The plumbing valve cover of claim 9, wherein said downward protruding member further comprising an aperture for at least one of passing plumbing through and assisting in accessing a valve handle for said sink supply line valve.

11. The plumbing valve cover of claim 10, said generally horizontal member further comprising a pitch on an upper surface.

12. The plumbing valve cover of claim 9, said generally horizontal member further comprising a pitch on an upper surface.

13. The plumbing valve cover of claim 8, said generally horizontal member further comprising a pitch on an upper surface.

14. A plumbing valve cover apparatus for avoiding interference between under-sink plumbing and a flexible spray hose for a spray nozzle, said plumbing valve cover apparatus comprising:

a member designed to span across a width of a sink supply line valve such to be positioned above said sink supply line valve, and designed to reposition said flexible spray hose towards the front of said sink supply line valve as said flexible spray hose is pulled upwards; and a member for securing said plumbing valve cover to at least one of:

a) a sink cabinet, and b) a wall.

15. The plumbing valve cover of claim 14, wherein said member designed to span across a width of a sink supply line valve further comprising a access region for positioning said plumbing valve cover about a sink supply line without disconnecting said sink supply line.

16. The plumbing valve cover of claim 14, wherein the plumbing valve cover further comprising at least one downward protruding member, whereby said downward protruding member is designed to reposition said flexible spray hose towards the front of said sink supply line valve as said flexible spray hose is pulled upwards.

17. The plumbing valve cover of claim 16, wherein said member designed to span across a width of a sink supply line valve further comprising a access region for positioning said plumbing valve cover about a sink supply line without disconnecting said sink supply line.

18. The plumbing valve cover of claim 17, wherein said downward protruding member further comprising an aperture for at least one of passing plumbing through and assisting in accessing a valve handle for said sink supply line valve.

19. The plumbing valve cover of claim 14, said generally horizontal member further comprising a pitch on an upper surface.

20. The plumbing valve cover of claim 17, said generally horizontal member further comprising a pitch on an upper surface.

* * * * *